US006123549A

United States Patent [19]

Williams

[11] Patent Number: 6,123,549

[45] Date of Patent: Sep. 26, 2000

[54] HIGH INTEGRITY ELECTRICAL CONNECTOR

[76] Inventor: Craig Williams, 2514 Greenleaf Ct., Wichita, Kans. 67226

[21] Appl. No.: 09/181,450

[22] Filed: Oct. 28, 1998

[51] Int. Cl.[7] ..... H01R 13/428; H01R 11/09

[52] U.S. Cl. ..... 437/744; 439/871; 439/723; 439/724

[58] Field of Search ..... 439/744, 787, 439/723, 724, 871

[56] References Cited

U.S. PATENT DOCUMENTS 4,676,572 6/1987 Booker ..... 439/301
4,701,004 10/1987 Yohn ..... 439/871

OTHER PUBLICATIONS

A copy of a page from the Nov. 1965 Deutsch Company Catalog Section.
A copy of a 1960–1970 Matrix Science Corporation Catalog Section entitled "Junction Devices".
Four (4) photographs showing prior art pin and socket type connections and a retention clip.

*Primary Examiner*—Gary F. Paumen
*Assistant Examiner*—Edwin A. León
*Attorney, Agent, or Firm*—Hovey, Williams, Timmons & Collins

[57] ABSTRACT

A high integrity electrical connector (10) including an electrically conductive retention clip (12) and an electrically conductive internal contact (14). The retention clip (12) includes a substantially tubular wall (16) presenting a longitudinally extending channel (18) and first and second opposed ends (20,22), the wall defining a window (24) intermediate the ends (20,22) and presenting first and second legs (32,34) extending into the channel (18). The internal contact (14) is received in the channel (18) and retained by the first and second legs (32,34) against longitudinal shifting in the channel (18). Lead wires (58,60) having respective terminals (62,64), when inserted into the channel (18) are retained by tines (40,42) which project into the channel (18) and engage circumscribing bands (68) on the terminals (62,64) to resist separation of the wires from the connector (10) and provide a high integrity splice capable of separation when desired by using a standard extraction/separation tool. The retention clip (12) thereby provides an integral, single element capable of conducting current between spliced wires and retaining them against undesired separation.

24 Claims, 2 Drawing Sheets

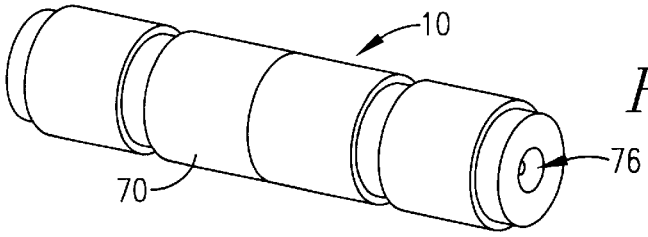
FIG. 1.
FIG. 2.
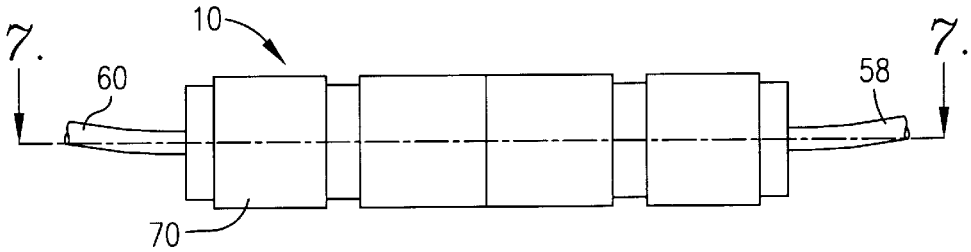
FIG. 3.
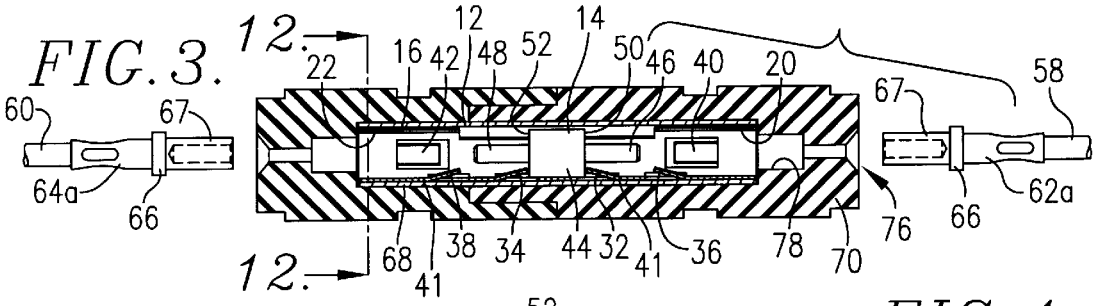
FIG. 4.
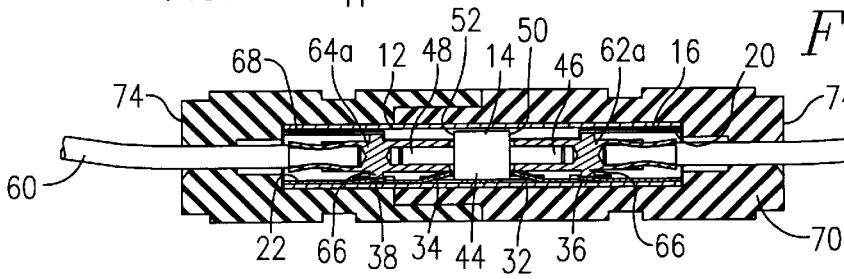
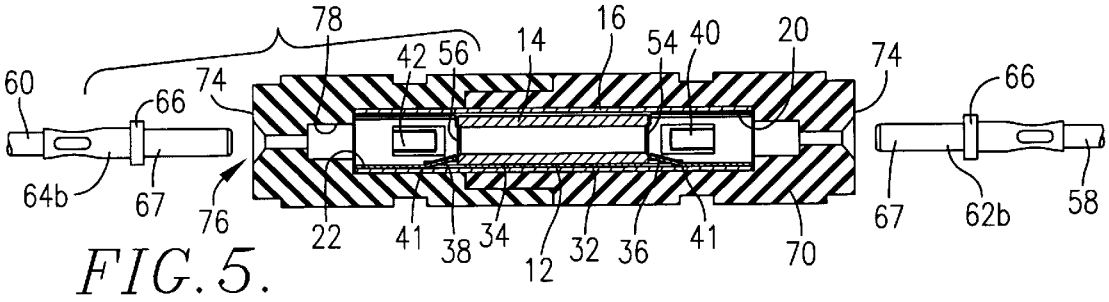
FIG. 5.
FIG. 6.
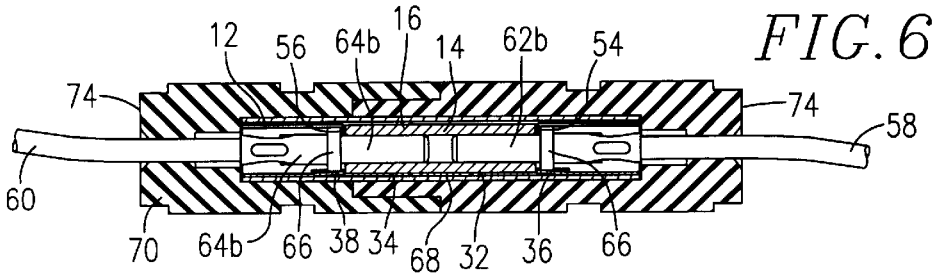

HIGH INTEGRITY ELECTRICAL CONNECTOR

BACKGROUND OF THE INVENTION

1. Field of the Invention

This invention relates to the field of electrical connectors. More particularly, the invention is concerned with a high-integrity, electrical in-line wire connector for coupling a pair of wires with crimp type pin terminals or crimp type socket terminals.

2. Description of the Prior Art

Electrical equipment requires wiring to send and receive signals and power. Most wires connect directly to an output or an input source enabling the electrical equipment to operate. However, some wires are required to be connected and disconnected to other wires forming in-line wire junctions.

The in-line wire junctions of the type concerned are at present often used is in electronics and aviation circuitry where high integrity in terms of connectivity, consistency of electrical resistance and resistance to separation are critical. The wires must resist separation from the connector, but be separable using a conventional military type insertion/extraction tool. These connections include two wires, each terminating in a crimp type contact. The contacts have been provided as pin-type contacts or socket-type contacts. For each socket contact terminated wire, a separate retention clip is used as part of the in-line wire junction. The sockets have multiple longitudinally oriented, circumferentially spaced slits, which are biased to a smaller circumference than that of the pin contact. The slits are configured to engage the pin contact more tightly, but to be effective requires tight manufacturing tolerances. The tight tolerances increase the costs of making the socket contacts. Pin-type contacts are also provided, but may shift in use to provide unacceptable variations in electrical connectivity with consequent and unacceptable deviations in electrical resistance.

A further problem with the standard in-line wire junction is the lack of a good hard splice. Any axial movement causes changes in resistance, which can lead to low current situations. If the in-line wire junction operatively connects the prime mover of an aircraft landing gear to the switch signaling the mover to actuate, a poor splice can result in electrical failure as small variations in current in low current signaling systems may result in a failure to lower or raise the landing gear. To get a solid splice connecting the two wires, it is necessary to solder the wires together, but this makes disassembly very difficult without cutting the wires.

There has thus developed a need for a simple, lightweight and economical connector which provides a high level of electrical integrity, is resistant to separation and permits selective separation of the connected wire terminals from the connector using a standard insertion/extraction tool.

SUMMARY OF THE INVENTION

The present invention solves the problems mentioned above and provides a distinct advance in the state of the art. In particular, the high integrity electrical connector hereof is reliable, economical and allows for solid connections and easy disconnection of wires with the further advantage that it is adaptable for use with both pin-type and socket-type terminals.

The high integrity wire connector of the present invention broadly includes an electrically conductive retention clip and an electrically conductive internal contact. The retention clip is unitary in construction and includes a substantially tubular wall presenting a longitudinally extending channel and first and second oppositely oriented open ends. The wall has structure defining a window in between the ends and presents a first and second leg extending radially inwardly into the channel. The internal contact is received in the channel and is retained by the first and second legs against longitudinally shifting in the channel. The retention clip thereby provides an additional current path to the internal contact by its configuration electrically contacting both wire terminals (once inserted) as well as the internal contact.

In preferred forms, the internal contact is either a double ended pin contact used to engage a socket-type terminal or a double ended socket contact used to engage a pin-type terminal. The double-ended socket may beneficially be a simple tubular cylinder which is economical to manufacture and install. The retention clip is configured to receive either the double ended pin or double ended socket without modification and still retain either of the aforementioned contacts against longitudinal shifting within the channel. Further, the assembled connector includes a copper tube surrounding the internal contact and retention clip and a silicone grommet maybe provided to encapsulate the connector. The resulting connector is highly resistant to water infiltration, requires no crimping and is thus capable of repeated separation and connection, economical to manufacture and assemble, and provides a high level of electrical integrity. The connector can be configured in a variety of different sizes to handle terminals sized for coupling to, for example, 22 gauge, 20 gauge, 16 gauge, 12 gauge or other sizes of terminals.

BRIEF DESCRIPTION OF THE DRAWINGS

FIG. 1 is a perspective view of the assembled preferred high integrity electrical connector in accordance with the present invention prior to insertion of the wires to be connected;

FIG. 2 is a side view of the electrical connector of FIG. 1 showing the wires received therein;

FIG. 3 is a sectional view of the electrical connector of FIG. 1 provided with a double ended pin internal contact received in the retention clip and socket-type terminals on the wires prior to their insertion into the connector;

FIG. 4 is a vertical sectional view of the electrical connector of FIG. 3 in use with a pair of wires with crimp socket terminals secured by the retention clip and receiving the respective pins at the internal contact therein;

FIG. 5 is a vertical sectional view of the electrical connector of FIG. 1 provided with a cylindrical tube internal contact received in the retention clip and pin-type terminals on the wires prior to their insertion into the connector;

FIG. 6 is a vertical sectional view of the electrical connector of FIG. 5 in use with a pair of wires with crimp pin terminals secured by the retention clip and received in the respective ends of the double-ended socket;

DETAILED DESCRIPTION OF THE PREFERRED EMBODIMENTS

Figures 7, 8, 9, 10, 11, 12, 13:
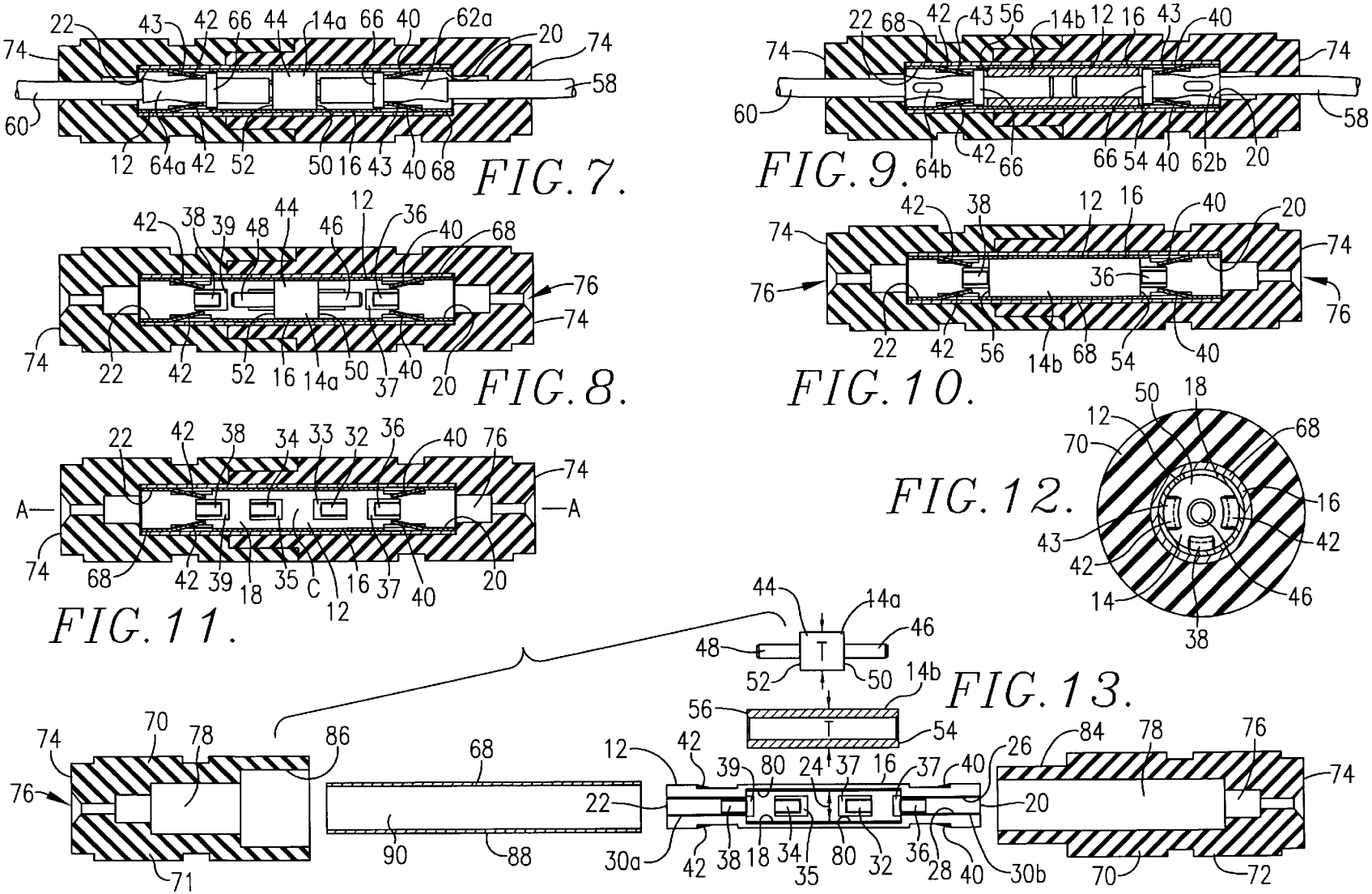
FIG. 7 is a horizontal sectional view of the electrical connector taken along line 7—7 of FIG. 2 in use with a pair of wires with crimp pin terminals connected to double-ended pin-type internal contact and held by the retention clip against separation.
FIG. 8 is a horizontal sectional view of the electrical connector of FIG. 7 with the wires and their respective terminals removed to show the double ended pin internal contact held within the channel.
FIG. 9 is a horizontal sectional view of the electrical connector taken along line 7—7 of FIG. 2 in use with a pair of wires with socket crimp terminals connected to a double-socket type internal contact and held by the retention clip against separation.
FIG. 10 is a horizontal type sectional view of the electrical connector of FIG. 9 with the wires and their respective terminals removed to show the double ended socket internal contact held within the channel.
FIG. 11 is a sectional view of the electrical connector of FIG. 1 with the internal contact removed for clarity to show the legs and retention tines longitudinally spaced along the channel.
FIG. 12 is a vertical sectional view of the electrical connector taken along line 12—12 of FIG. 3 to show the pin-type connector located within the channel, the radially inward extension of the legs and retention tines and the surrounding sleeve and grommet.
FIG. 13 is an exploded, front, partial sectional view of the electrical connector of FIG. 1 showing the alternate internal contacts and the retention clip in place to show the opposed edges and window for insertion at the internal contact.

The drawing figures illustrate a preferred high integrity electrical connector 10 in accordance with the present invention. The high-integrity electrical connector 10 includes an electrically conductive retention clip 12 and an electrically conductive internal contact 14, as well as electrically conductive sleeve 68 and grommet 70 of an electrically insulating material such as silicone rubber.

The retention clip 12 includes a substantially tubular wall 16 presenting a longitudinally extending channel 18, a first open end 20 and a second open end 22 opposite the first end 20. The wall 16 defines a window 24 intermediate the ends 20,22. Opposed edges 26,28 extend longitudinally from the window 24 to each of the ends 20,22 to define therebetween gap segments 30*a* and 30*b*. The window 24 and gap 30 permit the arcuate wall 16 to thereby yield during insertion of internal contact 14 through window 24. The window 24 in wall 16 is complementally configured to receive internal contact 14 therethrough and is bounded by opposed margins 80,82 which are preferably separated by a distance slightly less that the widest transverse dimension T of the internal contact 14. The wall presents a first, second, third, and fourth longitudinally aligned legs 32,34,36,38 extending radially and axially inwardly toward the center of channel 18. Also, the wall includes a first and second pair of opposed tines 40,42 circumferentially and longitudinally spaced relative to legs 32,34,36 and 38 as shown in FIGS. 11 and 12 extending into the channel 18 from the wall 16.

The channel 18 is substantially circular in transverse cross-section, interrupted only by the legs 32,34,36,38 and the opposed tines 40,42 extending inwardly from the wall 16, and the window 24 and gap 30 as shown by FIG. 12. The channel 18 extends longitudinally along axis A from the first end 20 to the second end 22. The open ends 20,22 are defined by the arcuate tubular wall, which is preferably a sector of a circle.

As shown in FIG. 13, the window 24 is intermediate and communicates with gap segments 30*a* and 30*b*. Each gap segment 30*a* and 30*b* and window 24 is generally rectangular in plan, although ovals or other shapes would be within the scope of the invention. The window 24 is substantially wider than the gap segments 30*a* and 30*b* to allow for the internal contact 14 to be inserted into the channel 18 through the window 24 while preserving structural integrity.

The margins 80,82 and edges 26,28 are resiliently yieldable to permit insertion of the internal contact 14 into the channel 18 through the window 24 and to retain the internal contact 14 after insertion. The preferred internal contacts 14 include a double ended pin internal contact 14*a* and a tube internal contact 14*b*.

The double ended pin internal contact 14*a* includes a central barrel portion 44 and first and second pins 46,48 extending generally longitudinally toward respective ones of said first and second ends 20,22. The barrel portion 44 presents a pair of shoulders 50,52 having a first diameter and the pins 46,48 present second diameters smaller than said first diameters whereby the shoulders are engaged by the first and second legs 32,34. The pins 46,48 are most preferably axially aligned and extend in opposite directions as shown in FIGS. 3, 4, 8 and 13. The double ended pin internal contact 14*a* is received in the channel 18 and retained by the first and second legs 32,34 against longitudinal shifting in the channel 18.

The tube internal contact 14*b* presents longitudinally spaced first and second substantially circular rims 54,56, each of said first and second rims 54,56 being engaged by the third and fourth legs 36,38 respectively. The tube internal contact 14*b* rests on legs 32, 34 when inserted into the channel 18 and is retained by the third and fourth legs 36,38 against longitudinal shifting in the channel 18.

The first and second legs 32,34 extend radially inwardly from the wall 16 into the channel 18 and are oriented, away from the respective end 20,22 most proximate thereto, each one of the first and second legs 32,34 extending toward the other of the first and second legs 32,34 toward center C. The third leg 36 is located intermediate the first leg 32 and the first end 20 and extends longitudinally away from the first end 20 and toward center C. The fourth leg 38 is located intermediate the second leg 34 and the second end 22 and extends longitudinally away from the second end 22 and toward center C. The first, second, third and fourth legs 32,34,36,38 are in substantial longitudinal alignment and are generally positioned diametrically opposite the window 24 and gap segments 30*a* and 30*b* along the tubular wall 16 as shown in FIG. 12.

The wall 16 defines leg openings 33,35,37,39 from which legs 32,34,36,38 respectively extend. The openings 33,35, 37,39 are rectangular in shape and are all similarly sized. Each leg 32,34,36,38 is also generally rectangular in shape and attached to the tubular wall 16 by a bend 41, the legs being formed by stamping from the metallic stock from which the retention clip 12 is formed. The legs 32,34,36,38 are resiliently yieldable to allow either internal contact 14 to be retained in the channel 18.

The preferred high integrity electrical connector 10 is configured to receive a first wire 58 and second wire 60 each having respective first and second terminals 62,64 configured to couple to said internal contact 14. To couple with a first embodiment of the connector 10 having a double ended pin internal contact 14*a* as shown in FIGS. 3, 4, 7 and 8, the first and second terminals 62,64 are socket terminals 62*a*, 64*a*. To couple with a tube internal contact 14*b*, the first and second terminals 62,64 are pin terminals 62*b*, 64*b*. Each of the first and second terminals 62,64 has a circumferentially extending band 66 which is radially raised relative to a head 67 of each terminal as shown in FIGS. 3 and 5.

When the terminals 62,64 are inserted into the channel 18 and coupled to the internal contact 14, the band 66 is engaged by a respective one of the first and second pairs 40,42 of retention tines 43 for inhibiting longitudinal shifting of the terminals 62,64 as shown in FIGS. 7 and 9. The first pair 40 of opposed tines 43 extends away from the first end 20 and the second pair 42 of opposed tines 43, extends toward the first end 20 and away from the second end 22. In use, each of the first and second terminals 62,64 are inserted into the respective open end 20,22. The respective pair 40,42 of retention tines 43 retain the terminal 62,64 by locking in behind the band 66 of the terminal 62,64. The wires 58,60 are removable from the electrical connector by insertion of a neck of an elongated, substantially tubular, conventional military-type insertion/extraction tool which passes through the channel 18 between the terminal 62,64 and the wall 16 to flatten the retention tines 43 and thereby disengage one pair 40,42 of retention tines 43 from the band 66 of the respective terminal 62,64. By flattening the retention tines 43, the tines 43 are freed form interferences with the band 66 and upon application of a pulling force on the wire 58,60, the respective terminal 62,64 may be extracted from the respective open end 20,22.

In a second embodiment of the electrical connector 10 using the tube internal contact 14*b* as illustrated in FIGS. 5, 6, 9 and 10, the third and fourth legs 36,38 centrally locate the tube internal contact 14*b* and put a side load on the band 66 for its respective terminal 62*b*, 64*b*. This forces the pin section of the terminal 62*b*, 64*b* to enter and contact the tube internal contact 14*b* thus providing electrical engagement of the pin terminal 62*b*, 64*b*. By contacting the respective band 66, the third and fourth legs 36,38 also allow the flow of electricity between the third and fourth legs 36,38 directly through the retention clip 12. This results in the stabilization of possible changes in the electrical resistance of the electrical connector 10 which can result from axial movements of the terminals 62*b*, 64*b* caused by movement on the wires 58,60 being connected.

The spring tension of the third and fourth legs 36,38 against each band 66 of the respective terminals 62,64 also performs a wiping action during engagement of the terminal 62,64 with the retention clip 12. The wiping action clears away any dielectric contaminate film that might exist on the terminal 62,64.

The retention clip 12 is preferably integrally formed of beryllium copper although it may be appreciated that other metals such as aluminum, silver or even gold could be used. The beryllium copper is preferably heat treated, providing each leg 32,34,36,38 and each pair of opposed retention tines 40,42 with spring tension. The retention clip 12 is electroplated after being heat treated to eliminate any possible oxidation of the retention clip material. Beryllium copper is preferred for its high conductivity and resiliency.

The high-integrity electrical connector 10 preferably includes an electrically conductive sleeve 68. The sleeve 68 is cylindrical and includes a preferably copper sleeve wall 88 surrounding an axially extending passageway 90 for receiving the retention clip 12 therein. The sleeve 68 thus substantially surrounds the retention clip 12 and internal contact 14. The sleeve 68 provides further electrical engagement for the electrical connector 10 and shields the retention clip from deformation.

The high-integrity electrical connector 10 further includes a resilient, electrically insulating grommet 70. The grommet 70 is provided initially in two interfitting grommet sections 71 and 72 presents a first and second radially inwardly extending lips 73,74 defining a central opening 76 therethrough and communicating with an internal chamber 78 receiving the sleeve 68, the internal contact 14 and the retention clip 12 therein. The connector 10 is assembled as shown in FIG. 13 by inserting the desired internal contact 14*a* or 14*b* through the window 24, then inserting the retention clip 12 into the tubular sleeve 68. The sleeve is then placed in the internal chamber 78 and an adhesive such as silicone rubber adhesive is applied to the exterior of cylindrical extension 84 at grommet sections 72 which is then inserted into collar 86 of grommet section 71 to bond the sections 71,72 and encapsulate the retention clip 12, contact 14 and sleeve 68 therein.

Those skilled in the art will now appreciate the benefits of the present invention. For example, the one piece construction of the retention clip 12 decreases the complexity and thus the cost of manufacturing electrical connectors. Another benefit is simplicity of assembly of the electrical connectors 10. The internal contacts are easily inserted through the window 24, but are securely held by the tubular wall 16 and the legs 32,34,36,38. Also, because the retention clip 12 is of an electrically conductive one piece construction, electric current will flow through it as well as the internal contact 14. This results in stabilization of possible changes in the electrical resistance of the electrical connector 10 during tensioning of the wires connected to the terminals to variations of less than one millohm. Further, because the terminals 62,64 are locked in by the respective pair of opposed tines 40,42, the wires 58,60 can be moved or placed in tension without the termination of the electrical connection.

Those skilled in the art will also appreciate that the present invention encompasses many variations in the preferred embodiments described herein. The preferred embodiment has only one leg on each side of the internal contact 14, but several legs could be positioned to locate the internal contact 14. As another example, the internal contacts are preferably a tube contact 14*b* or a double ended pin contact 14*a*, but the internal contact 14 could be any mechanism configured to be received and held against longitudinally shifting inside the tubular wall 16 of the retention clip 12 and complementally configured with a terminal. The shape of the retention clip 12 is circular in cross-section, but this could be varied. Additionally window 24 would not have to longitudinally extend to accommodate the entire length of, for example, the pin-type internal contact, but only the barrel portion thereof While shown as receiving a single wire for each terminal, the sleeves 68 of two or more connectors may be soldered together and encapsulated within a multi-terminal grommet for electrically joining a multiplicity of wires.

Having thus described the preferred embodiments of the present invention, the following is claimed as new and desired to be secured by Letters Patent:

What is claimed is:

1. A high integrity electrical connector comprising:

an electrically conductive retention clip including a substantially tubular wall presenting a longitudinally extending channel and first and second opposed ends, said wall defining a window intermediate said ends and presenting first and second legs extending inwardly from said wall into said channel away from the respective end most proximate thereto, wherein each one of said first and second legs extends toward the other of said first and second legs; and an electrically conductive internal contact received in said channel and complementarily configured and sized relative to said window for passage therethrough in a direction transverse to said longitudinal channel, said contact presenting longitudinally spaced first and second shoulders in engagement with a respective one of said first and second legs for retaining said contact against longitudinal shifting in said channel.

2. The high integrity electrical connector as set forth in claim 1, said wall further including first and second longitudinally extending edges defining therebetween a longitudinally extending gap communicating with said window.

3. The high integrity electrical connector set forth in claim 2, wherein said edges are resiliently yieldable to permit insertion of said contact into said channel through said window and to retain said contact within said channel after insertion.

4. The high integrity electrical connector as set forth in claim 1, wherein said contact includes a central barrel portion and first and second pins extending generally longitudinally toward respective ones of said first and second ends.

5. The high integrity electrical connector as set forth in claim 4, said shoulders being substantially circular and having a first diameter and said pins having second diameters smaller than said first diameter.

6. The high integrity electrical connector as set forth in claim 1, wherein said contact is a tube.

7. The high integrity electrical connector as set forth in claim 1, wherein said first and second legs extend inwardly from said wall into said channel, away from the respective end most proximate thereto, each one of said first and second legs extending toward the other of said first and second legs.

8. The high integrity electrical connector as set forth in claim 1, further including third and fourth legs extending inwardly from said wall into said channel, said third leg located intermediate said first leg and said first end and extending away from said first end, said fourth leg being located intermediate said second leg and said second end and extending away from said second end.

9. The high integrity electrical connector as set forth in claim 8, wherein said first, second, third and fourth legs are in substantial longitudinal alignment.

10. The high integrity electrical connector as set forth in claim 1, said wall including first and second pairs of opposed retention tines extending into said channel from said wall, said first pair of retention tines extending away from said first end, said second pair of retention tines extending toward said first end and away from said second end.

11. The high integrity electrical connector as set forth in claim 10, including first and second wires having respective first and second terminals respectively coupled to said contact, each one of said first and second terminals having a raised, circumferentially extending band engaged by a respective one of said first and second pairs of retention tines for inhibiting longitudinal shifting of said terminals.

12. The high integrity electrical connector as set forth in claim 11, wherein each of said first and second legs and first and second pairs of retention tines are in direct physical contact with a respective one of said first and second terminals.

13. The high integrity electrical connector as set forth in claim 1, including an electrically conductive sleeve substantially surrounding said retention clip and contact.

14. The high integrity electrical connector as set forth in claim 13, wherein said sleeve is copper and substantially cylindrical.

15. The high integrity electrical connector as set forth in claim 13, including a resilient, electrically insulating grommet presenting first and second radially inwardly extending lips having a central opening therethrough and communicating with an internal chamber receiving said sleeve contact and retention clip therein.

16. An electrical junction comprising:

a first wire having a first electrically conductive terminal;

a second wire having a second electrically conductive terminal;

a unitary retention clip presenting a longitudinal axis and having a substantially tubular wall defining therein a channel, said retention clip having first and second axially spaced ends, said wall including first and second tines projecting into said channel for respectively engaging said first and second terminals when receiving in said retention clip to provide a first current flowpath and to prevent axial separation between said clip and said terminals; and an electrically conductive internal contact and received in said channel and electrically connected to said first and second electrically conductive terminals to provide a second current flowpath for stabilization of possible changes in the electrical resistance.

17. An electrical junction as set forth in claim 16, wherein said retention clip includes a first leg and a second leg each positioned intermediate said ends and engaging said contact against longitudinal movement along said channel.

18. An electrical junction as set forth in claim 17, wherein said internal contact is a tube contact presenting longitudinally spaced first and second substantially circular rims, each of said first and second legs engaging a respective one of said first and second rims.

19. An electrical junction as set forth in claim 17, wherein said contact is a double-ended pin contact including a central barrel portion and first and second pins extending generally longitudinally toward said first and second ends, said first and second legs engaging said barrel, said first and second pins being received into respective ones of said first and second terminals.

20. An electrical junction as set forth in claim 17, wherein said retention clip includes a third leg and a fourth leg positioned intermediate said ends, said third leg extending into said channel in contact with said first terminal, and said fourth leg extending into said channel in contact with said second terminal and providing a third current flowpath from the first terminal through the retention clip to the second terminal.

21. An electrical junction as set forth in claim 18, wherein during axial tensioning of said wires, the change in electrical resistance through said connector is less than one millohm.

22. An electrically conductive retention clip for use as an electrical connector comprising:

an electrically conductive, substantially tubular wall presenting a longitudinally extending channel and having first and second open ends;

first and second legs extending from said wall into said channel and located intermediate said ends, said first leg extending toward said second leg and said second leg extending toward said first leg;

third and fourth legs extending from said wall into said channel and located intermediate said ends, said third leg being located intermediate said first leg and said first end, and said fourth leg being located intermediate said second leg and said second end; and an electrically conductive internal contact having spaced-apart ends presenting rims thereon, said internal contact being received in said channel with said rims intermediate and engaged by said third and fourth legs to resist longitudinal shifting of said internal contact within said channel and to provide a first current flowpath, with said first and second legs positioned to engage said internal contact intermediate the rims to provide a second current flowpath.

23. An electrical junction comprising:

a first wire having a first electrically conductive terminal and a raised, circumferentially extending band;

a second wire having a second electrically conductive terminal and a raised, circumferentially extending band;

a unitary electrically conductive retention clip having a substantially tubular wall defining therein a channel, said retention clip having first and second spaced-apart ends, said wall including first and second legs extending inwardly into the channel away from the end most proximate thereto and positioned in engagement with said bands of said first and second terminals for defining a first current flowpath, third and fourth legs extending inwardly into said channel and located intermediate said first and second legs, said wall further including first and second spaced-apart tines, said first tine being located intermediate said first leg and said first end and engaging said band of said first terminal against movement toward said first end and said second leg being located intermediate said second leg and said second end and engaging said band of said second terminal against movement toward said second end, said first and second tines and said first and second terminals defining a second current flowpath; and an electrically conductive internal contact located within said channel, said contact being coupled to said first and second terminals to provide a third current flowpath and said internal contact being in engagement with said third and fourth legs to define a fourth current flowpath.

24. An electrical junction comprising:

a first wire having a first electrically conductive terminal and a raised, circumferentially extending band;

a second wire having a second electrically conductive terminal and a raised, circumferentially extending band;

an electrically conductive retention clip having a substantially tubular wall defining therein a channel, said retention clip having first and second spaced-apart ends, said wall including first and second legs extending inwardly into the channel away from the end most proximate thereto, third and fourth legs extending inwardly into said channel and located intermediate said first and second legs, said wall further including first and second spaced-apart tines, said first tine being located intermediate said first leg and said first end and engaging said band of said first terminal against movement toward said first end and said second leg being located intermediate said second leg and said second end and engaging said band of said second terminal against movement toward said second end, said first and second tines and said first and second terminals defining a first current flowpath; and an electrically conductive internal tube contact located within said channel, said contact being coupled to said first and second terminals to provide a second current flowpath, being positioned in engagement with said first and second legs to resist movement of said contact within said channel and to provide a third current flowpath, and said internal tube contact being in engagement with said third and fourth legs to define a fourth current flowpath.

* * * * *